United States Patent [19]

Wentzel

[11] 4,212,114

[45] Jul. 15, 1980

[54] APPARATUS FOR PREHEATING SOLID PARTICULATE MATERIAL

[75] Inventor: William C. Wentzel, Allentown, Pa.

[73] Assignee: Fuller Company, Bethlehem, Pa.

[21] Appl. No.: 879,839

[22] Filed: Feb. 22, 1978

[51] Int. Cl.[2] ..... F26B 17/12

[52] U.S. Cl. ..... 34/167; 34/168; 34/176; 432/101

[58] Field of Search ..... 432/58, 106, 96, 101; 34/167, 168, 176

[56] References Cited

U.S. PATENT DOCUMENTS

| | | | |
|---|---|---|---|
| 3,284,072 | 11/1966 | Kramer | 34/167 |
| 3,539,164 | 11/1970 | Brachthauser | 34/174 |
| 3,832,128 | 8/1974 | Paul | 432/17 |
| 3,903,612 | 9/1975 | Warshawsky et al. | 432/58 |

FOREIGN PATENT DOCUMENTS

| | | | |
|---|---|---|---|
| 548617 | 11/1957 | Canada | 34/167 |
| 2313900 | 10/1974 | Fed. Rep. of Germany | 34/168 |
| 513727 | 10/1939 | United Kingdom . | |
| 1139224 | 1/1969 | United Kingdom . | |

*Primary Examiner*—Larry I. Schwartz

*Attorney, Agent, or Firm*—Frank H. Thomson

[57] ABSTRACT

Apparatus for preheating solid particulate material which material is to be subjected to thermal processing in a furnace. The preheater includes a vessel having an inlet for solid particulate material to be heated, an outlet for preheated material, an inlet for hot exhaust gas from the furnace and an outlet for spent preheating gas. The various inlets and outlets are positioned with respect to each other to achieve countercurrent contact between gas and solids. A gas-solids contact zone is defined within the vessel. A plurality of superimposed conduits connect the solid material inlet with the gas-solids contact zone. A valve is positioned in each of these conduits to control the flow of material to the gas-solids contact zone and thereby control the depth of material within that zone. The greater the depth of material within the gas solids contact zone, the greater amount of preheating that will be accomplished due to a greater length of time that the solid particulate material is exposed to the hot gas. The valves may taken the form of simple cut off gates or open-ended cylinders rotatable within a cylindrical inlet conduit, each having an opening which is adapted to be selectively aligned with the conduit leading to the gas-solids contact zone.

8 Claims, 8 Drawing Figures

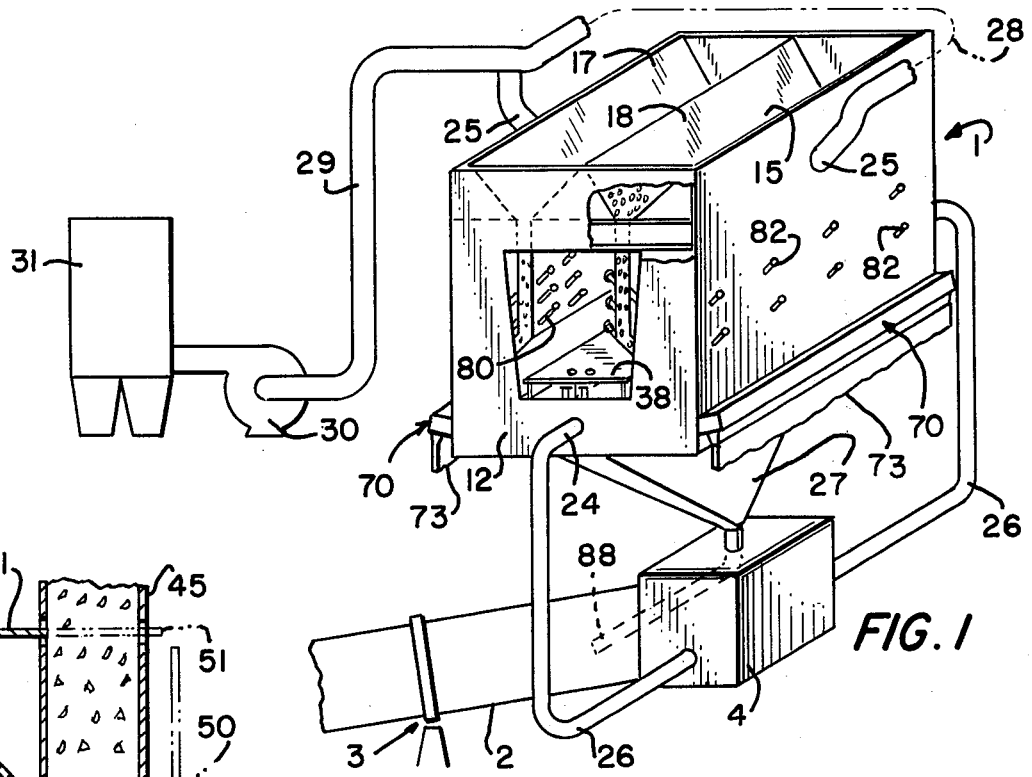
FIG. 1
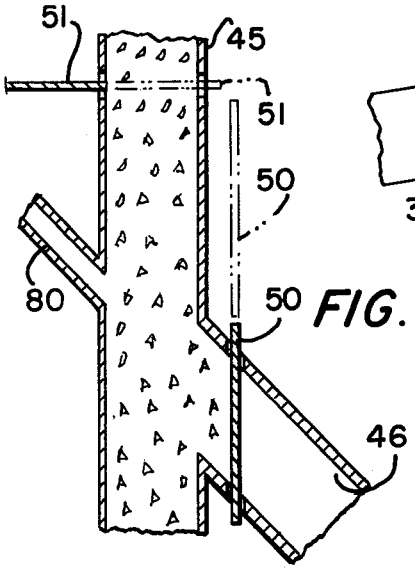
FIG. 3
FIG. 5
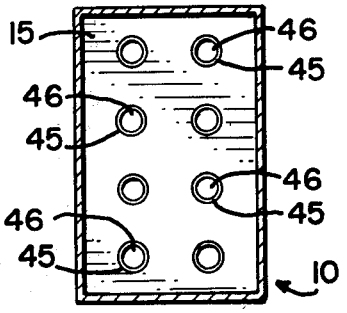
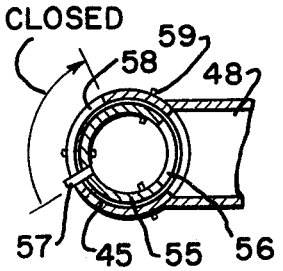
FIG. 8
FIG. 4
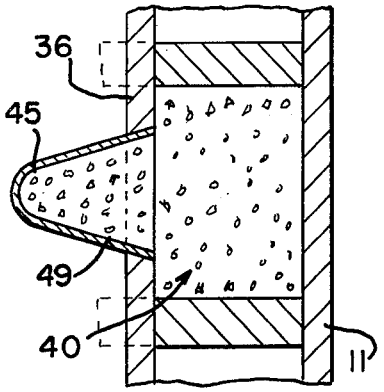
FIG. 7
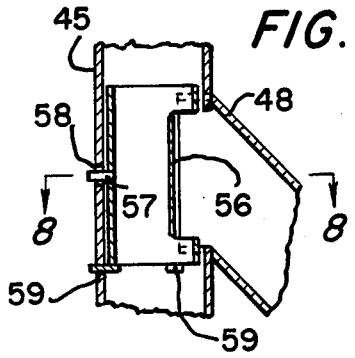

APPARATUS FOR PREHEATING SOLID PARTICULATE MATERIAL

BACKGROUND OF THE INVENTION

The present invention relates to a gas-solids heat exchanger and in particular to a preheater for solid particulate material which is operatively associated with a furnace for thermal processing of the solid particulate material.

The present invention is particularly designed for use in preheating solid particulate material such as limestone which is too large to be placed in suspension in a gas stream prior to feeding that material to a furnace such as a rotary kiln in order to calcine the limestone. The general concept of using the exhaust gases from a limestone calcining kiln or other thermal processing to preheat the stone feed is known. As is generally known in the art, the purpose of using such a preheater is to use the hot exhaust gases from the kiln to heat the raw material being supplied to the kiln. Since the kiln feed material is at a temperature greater than ambient, less fuel must be burned in the kiln in order to heat the material to the temperature necessary to achieve the desired thermal process such as calcining the limestone. Although the invention will be described as a preheater for a lime calcining system, the invention can be applied to other thermal processes such as the manufacture of lightweight aggregate.

Preheating apparatus of the type to which the present invention relates were known prior to the present invention and two such apparatus are described in U.S. Pat. Nos. 3,832,128 and 3,903,612. In each of these apparatus the amount of preheating which takes place in the apparatus is controlled by controlling the length of the preheating zone. By using such a control the length of time the solid particulate material is exposed to the high temperature exhaust gases is controlled and the temperature at which material is discharged from the preheater into the furnace can be controlled. In addition, the pressure drop across the preheater apparatus can be controlled.

The two above-mentioned U.S. Patents control the length of the gas flow path through the gas-solids contact zone. If less preheating of the material is desired, the flow path of the gas is short. If more preheating is desired, for example, when larger stone is being processed, valve means are operated to increase the length of the flow path of the gas through the gas-solids contact zone.

Although the apparatus of the above-referenced patents does achieve preheating of the solid particulate material and control can be effective, for purposes of design simplification, economics of manufacture and ease of operation of the preheater, it may be advantageous to control the gas-solids contact zone by controlling the flow of solid material rather than controlling the flow of the gas. Since the length of time the material is subjected to contact by the hot gas will control the increase in the temperature of the materials, the deeper the bed of material through which the hot exhaust gas is passing, the higher the temperature of the finally preheated material. Of course, once temperature equilibrium between the gas and solids is achieved, additional depth is only a disadvantage, but it is unlikely that temperature equilibrium will be reached in this type of apparatus. By the present invention, the length of the gas-solids contact zone is controlled by using a fixed gas flow path through which all of the gas passes and varying the depth of material within that gas flow path. Not only can the temperature of the solid material supplied to the kiln thus be controlled, but also the pressure drop across the preheater can be controlled.

SUMMARY

It is therefore the principal object of this invention to provide a gas-solids heat exchange apparatus which includes an improved control arrangement.

It is a further object of this invention to provide a gas-solids heat exchange apparatus which includes a novel means for controlling the effective length of the gas-solids contact zone.

It is a still further object of this invention to provide a preheater for solid particulate material which is less likely to have material plugs than prior apparatus and in the event such plugs do occur, the apparatus includes provisions for removing them.

In general, the foregoing and other objects of this invention will be carried out by providing a gas-solids heat exchange apparatus including a vessel having an inlet for solid particulate material, an outlet for solid particulate material, an inlet for gaseous fluid and an outlet for gaseous fluid; means defining a gas-solids contact zone intermediate the inlet and outlet for gaseous fluid whereby solid particulate material moves from the inlet for solid particulate material to the outlet for solid particulate material and passes through the gas-solids contact zone and the gaseous fluid flows from the inlet for gaseous fluid to the outlet for gaseous fluid through the gas-solids contact zone; and means intermediate the inlet for solid particulate material and the gas-solids contact zone for controlling the supply of solid particulate material to the gas-solids contact zone for controlling the depth of material in the gas-solids contact zone.

BRIEF DESCRIPTION OF THE DRAWINGS

The invention will be described in connection with the annexed drawings wherein:

FIG. 1 is a perspective view of preheating apparatus of the present invention and associated thermal processing furnace;

FIG. 3 is a fragmentary sectional view on an enlarged scale of a portion of the present invention shown in FIG. 2;

FIG. 4 is a fragmentary sectional view taken on the line 4—4 of FIG. 2;

FIG. 5 is a sectional view on a reduced scale taken on the line 5—5 of FIG. 2;

FIG. 7 is a view on an enlarged scale of a portion of the modification shown in FIG. 6; and FIG. 8 is a sectional view taken on the line 8—8 of FIG. 7.

DESCRIPTION OF THE PREFERRED EMBODIMENT

Figure 2:
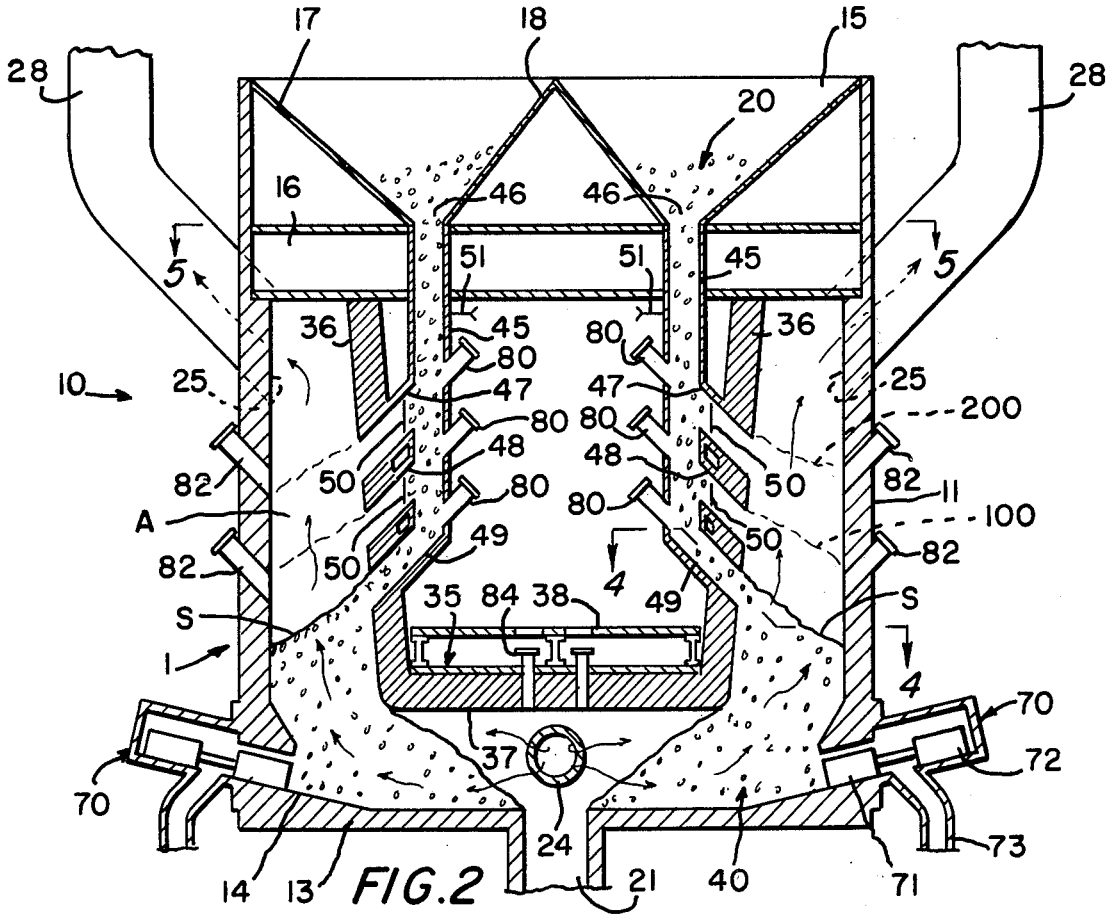
FIG. 2 is a sectional view of the preheating apparatus of the present invention.

Referring to the drawing and in particular to FIG. 1 there is shown a gas-solids heat exchange apparatus or preheater generally indicated at 1. A thermal processing furnace, such as a rotary kiln 2, is flow connected to the preheater 1 by means of a manifold 4. The kiln is mounted for rotation by means of conventional roller supports and tires generally indicated at 3. As will be described hereinafter, material to be thermally processed is supplied to the preheater 1, passes therethrough for initial heating and is then supplied to the kiln 2 for further thermal processing. Hot gas from the combustion which takes place in the kiln 2 is supplied to the preheater 1 for heating the material in the preheater. In a complete system, the product of the kiln may be cooled by blowing ambient air therethrough. This cooling air is heated by the hot material and can serve as preheated combustion air.

Referring to FIG. 2, the preheater includes a vessel generally indicated at 10 having sidewalls 11, end walls 12 (FIG. 1) and a floor 13. The floor 13 may include an inclined portion 14 which assists in the design of pushers used for advancing material through the vessel.

The vessel 10 includes a hopper 15 supported on the top thereof by suitable beams 16. The hopper 15 includes slope sheets 17 and 18 to direct solid particulate material toward an inlet generally indicated at 20. Material may be supplied to the hopper 15 by any suitable apparatus (not shown) such as a conveyor belt.

In addition to the inlet 20 for solid particulate material, the vessel 10 includes an outlet 21 for solid particulate material, an inlet 24 for gaseous fluid and a pair of outlets 25 for spent preheating gas. As will become apparent, the inlet 24 and outlet 25 for gaseous fluid and the inlet 20 and outlet 21 for solid particulate material are positioned to achieve generally countercurrent contact between the gaseous fluid and the solid particulate material. The gas inlet 24 is flow connected by conduits 26 to manifold 4 for supplying hot exhaust gas from the kiln 2 to the preheater 1. The gas outlets 25 are flow connected by conduits 28 and 29 to a fan 30 and suitable dust collector 31 and then to atmosphere. If desired, a cyclone separator (not shown) may be interposed between the outlets 25 and the fan 30. The solids outlet 21 is flow connected by hopper 27 and feed pipe 88 to the feed end of the kiln 2.

A U-shaped wall means generally indicated at 35 is positioned within the vessel 10 and spaced from the sidewalls 11 and floor 13 as shown in FIG. 2. The wall means 35 includes legs 36 and a generally horizontal connecting member 37. The wall means 35 extends between end walls 12 and is supported by beams 16. Suitable beams 38 may also be provided for supporting the U-shaped wall means 35. The floor 13, walls 11 and 12 and U-shaped member 35 define a gas-solids contact zone, generally indicated at 40.

The inlet 20 is defined by at least one and as shown in FIG. 5 preferably a plurality of cylindrical inlet conduits 45 open at one end 46 to the hopper 15, for receiving solid particulate material. The conduits 45 are preferably arranged in rows on opposite sides of the vessel 10. A plurality of superimposed conduits 47, 48 and 49 extend from each inlet conduit 45 through leg 36 of wall means 35 to flow connect the inlet conduits 45 to the gas solids contact zone 40. Each of the conduits 47 to 49 has a valve means 50 operatively associated therewith for controlling the flow of solid particulate material through its associated conduit. This valve means 50 may take the form of a slide gate diagrammatically illustrated in FIG. 3. The valves 50 and the conduits 47 to 49 define means intermediate the inlet 20 for solid particulate material and the gas solids contact zone for controlling the depth of material in the gas-solids contact zone.

When the valve 50 is in open position, solid particulate material will flow through the cylindrical inlet conduit 45 and associated superimposed conduits 47 to 49 which are open to the gas-solids contact zone 40. When valve 50 is in the closed position illustrated in FIG. 3 material will be prevented from flowing through the associated conduits 47 to 49. An additional slide gate 51 shown in FIG. 3 may be used to prevent flow of solid particulate material through the inlet conduit 45. Material will flow through conduit 45 and the open conduits 47 to 49. In FIG. 2, conduit 49 is open and conduits 45 and 46 are closed by their respective valve 50. Material will flow into gas-solids contact zone 40 until the surface S on each of vessel 10 closes the open end of conduit 49. If the valve 50 associated with conduit 48 is opened, then material would fill gas solids contact zone 40 to cover conduit 48 as shown by dotted line 100 thus making the depth of material in the gas-solids contact zone greater. Similarly, if the valve 50 associated with conduit 47 is opened, material will fill the gas-solids contact zone to cover conduit 47 as shown by dotted line 200 in FIG. 2 making the depth of material even greater. Normally, the valve 50 associated with conduit 49 is always open and if a deeper bed of material is desired, the higher conduit 48 is opened, and if an even deeper bed is required, conduit 47 is also opened. Therefore, if a deeper bed or deeper gas-solids contact zone 40 is desired, the conduits 47 to 49 are opened in sequence from the bottom to the top. If a shallow bed of material for shallow gas-solids contact zone 40 is desired, the conduits 47 to 49 are closed in sequence from the top to the bottom.

In order to remove material from the vessel 10 and particularly the gas-solids contact zone 40, a suitable piston-cylinder arrangement or pusher assembly generally indicated at 70 may be provided for pushing material along the floor 13 toward outlet 21 in a manner well known in the art. The actuator 70 may include a pusher element 71 and a piston-cylinder actuator 72 which may be hydraulically or pneumatically actuated in any manner well known in the art. A material outlet 73 is provided in the event material works its way behind the pusher element 72. The sloped floor 14 permits ease of design of the pusher assembly 70. As the pushers are reciprocated, preheated material is moved along the floor 13 to solid particulate material outlet 21 and then falls by gravity through hopper 27 and feed pipe 28 to kiln 2. As material is removed from the gas-solids contact zone 40, new material flows from hopper 15, through inlet conduit 45 and the conduits 47, 48 and/or 49 which are open into the gas-solids contact zone to thereby provide a continuous flow of material through the preheater. The depth of material in the gas-solids contact zone 40 is maintained generally constant.

Hot exhaust gas from the kiln 2 flows into manifold 4 and through conduits 26 to gaseous fluid inlet 24. The hot exhaust gas flows through the gas-solids contact zone 40 as illustrated by the arrows in FIG. 2 to the area A between sidewalls 11 and legs 36 above the surface S of material in the gas-solids contact zone 40. During its passage through the gas-solids contact zone, heat is transferred from the hot gas to the solid particulate material to thereby heat the material. The spent preheating gas is then exhausted from the preheating zone 40 and area A through the outlet for gas 25 and then to ducts 28 and 29. Since the gas is flowing in a generally upward direction from inlet 24 to outlet 25 and the solid particulate material is moving in a generally downward direction from inlet 20 to outlet 21, generally countercurrent contact between the gas and solid material is achieved.

The amount of heat which will be transferred from the hot gas to the solid particulate material will be a function of the length of time the gas and stone are in contact with each other. The deeper the bed of material in the gas-solids contact zone, the longer the hot gas will be in contact with the stone. Hence, as the depth of material increases, the heat transfer will increase and the temperature of the material being discharged through outlet 21 will increase. It can thus be seen that by controlling the depth of material in the gas-solids contact zone 40 by controlling the various valves 50 to control the flow of material through conduits 47, 48 and 49, the amount of preheating of the solid particulate material can be controlled. It should also be pointed out that as the depth of material increases, the pressure drop across the vessel 10 and the preheater-kiln system as a whole will increase. Thus, the pressure drop is also controlled by controlling material depth. Whether the stone is fine or coarse will, of course, also have an effect on the pressure drop and the amount of preheating.

Since the inside of the vessel 10 will be hot, some of the material is likely to become sticky and in some instances can cause plugging of the various material flow passages in the vessel. Accordingly, a series of means defining poke holes 80 which are substantially aligned with the conduits 47 to 49 are provided. These poke holes 80 form part of inlet conduits 45. If material becomes sticky and plugs the passages 47 to 49, a suitable rod can be inserted through the poke holes 80 to clear the passages 47 to 49. Additionally, poke holes 82 may be provided in the sidewalls 11 to clear material which may be stuck in the gas-solids contact zone 40 between the member 37 and the floor 13. Additional poke holes 84 can be provided in the leg 37 of U-shaped member 35 to permit cleaning of outlet 21.

Figure 6:
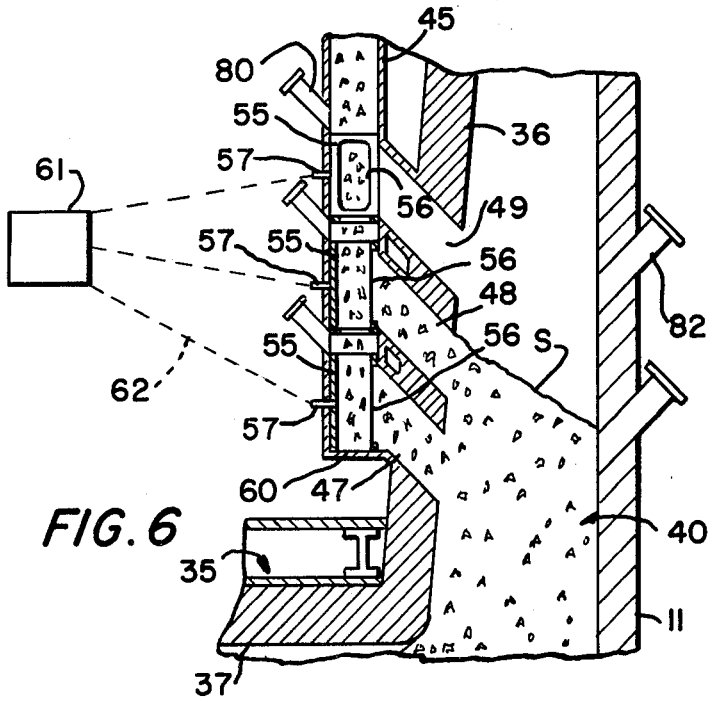
FIG. 6 is a fragmentary sectional view of the present invention employing a modified control valve with accompanying controls shown diagrammatically.

In FIGS. 6 to 8 there is illustrated a modified valve arrangement which may be used instead of the slide gate valves 50 illustrated in FIGS. 2 and 3. With this arrangement, the inlet conduit 45 is cylindrical. A plurality of open ended cylindrical valve members 55 are mounted for rotation within the conduit 45 and are spaced apart from each other so that each cylindrical member 55 is adjacent to and operatively associated with one of the superimposed conduits 47, 48 and 49. Each valve member 55 includes an opening 56 in the side thereof which opening is adapted to be selectively aligned with the conduit 47, 48 or 49 with which it is operatively associated. The valve members 55 also include an operator 57 adapted to extend through a slot 58 in conduit 45. Suitable valve holders 59 are circumferentially spaced around the inside of conduit 45 to hold each of the valve members 55 in place. In the embodiment of FIGS. 6 to 8, the conduit 45 is open at one end to the hopper 15 in a manner similar to FIG. 2, but the other end of conduit 45 is closed at 60 rather than being integral with conduit 49 as in FIG. 2.

Also shown in FIG. 6, an operator 61 may be connected by any suitable mechanical, electrical or pneumatic means 62 to each of the operators 57 for selectively rotating the valve members 55 to align the openings 56 with its associated conduit. It should be apparent that when the opening 56 is aligned with its respective conduit 47, 48 or 49, material will flow down conduit 45 through the valves 55 which are open to their associated conduits 47 to 49 and the gas-solids heat exchange zone 40. If the valve member 55 closes communication to its associated conduit, material will pass through the valve toward the next valve member.

The operation of the embodiment of FIG. 6 is the same as that of FIG. 2. When the preheater is first supplied with stone, it will pass from hopper 15 through conduit 45 toward heat exchange zone 40. If none of the valves 55 are open, material will merely fill conduit 45. If the valve 55 associated with conduit 47 is open, material will flow through conduit 47 until the depth of material covers conduit 47. The duct 45 will then fill up to the opening 56 which is in communication with conduit 48 and material will flow through that conduit 48 until the depth of material in preheating zone 40 closes conduit 48. As illustrated in FIG. 6 the valve 55 associated with conduit 49 is closed. As a result, the level S of material in the preheater zone will remain as shown in that Figure. As material is withdrawn from vessel 10, new material will flow down conduit 45 to the highest conduit 47 to 49 that is open to maintain the desired material depth.

Although the present invention has been illustrated as having a three level control, it should be understood that more or less than three control levels could be established through proper design. It is even contemplated by the present invention that an infinite level control could be established through proper design. The important feature is that the depth of material within the gas-solids contact zone be controlled. It should also be considered as within the broad scope of this invention to control both material depth and the gas flow path.

From the foregoing it should be apparent that the objects of this invention have been carried out. The depth of material in the preheater zone can be controlled to thereby control the amount of preheating of material. It is intended that the foregoing be merely a description of a preferred embodiment and that the invention be limited only by that which is within the scope of the appended claims.

I claim:

1. Apparatus for preheating solid particulate material which is to be heat processed in a furnace comprising;

a vessel having sidewalls, end walls and a floor and having at least one inlet for solid particulate material to be preheated, an outlet for preheated solid particulate material adapted to be flow connected to a furnace, an inlet for hot exhaust gases from the furnace for preheating the solid particulate material and an outlet for spent preheating gases;

means defining a gas-solids contact zone within said vessel intermediate the inlet and the outlet for solid particulate material and intermediate the inlet and the outlet for gas whereby the solid particulate material which moves from its inlet to its outlet and the gas which moves from its inlet to its outlet pass through the gas-solids contact zone;

a plurality of conduits for conducting solid particulate material from the inlet for solid particulate material to the gas-solids contact zone;

a plurality of valve means, each operatively associated with one of said conduit means for controlling the flow of solid particulate material through its associated conduit for controlling the depth of material in said gas-solids contact zone;

means for moving solid particulate material from said gas-solids contact zone to said outlet for preheated solid particulate material;

a U-shaped wall means having legs and a generally horizontal member connecting said legs mounted in said vessel and spaced from said sidewalls and said floor; and said gas-solids contact zone is defined by said sidewalls, end walls, floor and said U-shaped wall means.

2. Apparatus for preheating solid particulate material according to claim 1 wherein said inlet for hot exhaust gas is positioned between said floor and the horizontal member of said U-shaped wall means and the outlet for spent preheating gas is positioned in a sidewall above said gas-solids contact zone.

3. Apparatus for preheating solid particulate material according to claim 1 wherein at least some of said conduits are superimposed upon each other and each of said conduits extends through the legs of said U-shaped wall means.

4. Apparatus for preheating solid particulate material according to claim 3 wherein said means for moving solid particulate material from said gas-solids contact zone to said outlet for preheated material is positioned for moving solid particulate material along said floor toward the outlet for preheated solid particulate material.

5. Apparatus for preheating solid particulate material which is to be heat processed in a furnace comprising;

a vessel having at least one inlet for solid particulate material to be preheated, an outlet for preheated solid particulate material adapted to be flow connected to a furnace, an inlet for hot exhaust gases from the furnace for preheating the solid particulate material and an outlet for spent preheating gases;

means defining a gas-solids contact zone within said vessel intermediate the inlet and the outlet for solid particulate material and intermediate the inlet and the outlet for gas whereby the solid particulate material which moves from its inlet to its outlet and the gas which moves from its inlet to its outlet pass through the gas-solids contact zone;

a plurality of conduits for conducting solid particulate material from the inlet for solid particulate material to the gas-solids contact zone;

a plurality of valve means, each operatively associated with one of said conduit means for controlling the flow of solid particulate material through its associated conduit for controlling the depth of material in said gas-solids contact zone; and means for moving solid particulate material from said gas-solids contact zone to said outlet for preheated solid particulate material;

said inlet for solid particulate material is at least one cylindrical conduit connected at one end to a source of solid particulate material and said plurality of conduits are superimposed upon each other and connected to said cylindrical conduit along its length.

6. Apparatus for preheating solid particulate material according to claim 5 wherein each of said valve means is an open ended cylindrical member mounted in said cylindrical conduit having an opening in the side thereof adapted to be selectively aligned with the conduit with which it is aligned.

7. Apparatus for preheating solid particulate material according to claim 6 wherein said vessel includes sidewalls, end walls and a floor; a U-shaped wall means having legs and a generally horizontal member connecting the said legs is mounted in said vessel and spaced from said sidewalls and said floor; said gas solids contact zone being defined by said sidewalls, end walls, floor and said U-shaped wall means.

8. Apparatus for preheating solid particulate material according to claim 7 wherein said inlet for hot exhaust gas is positioned between said floor and the horizontal member of said U-shaped wall means and the outlet for spent preheating gas is positioned in the sidewall above said gas-solids contact zone.

* * * * *